US005828268A

United States Patent [19]

Ando et al.

[11] Patent Number: 5,828,268

[45] Date of Patent: Oct. 27, 1998

[54] MICROWAVE SWITCHES AND REDUNDANT SWITCHING SYSTEMS

[75] Inventors: Michael N. Ando, Torrance; Clinton F. Steidel, La Mirada, both of Calif.

[73] Assignee: Hughes Electronics Corporation, Los Angeles, Calif.

[21] Appl. No.: 870,148

[22] Filed: Jun. 5, 1997

[51] Int. Cl.[6] ..... H01P 1/12

[52] U.S. Cl. ..... 330/124 D; 333/101; 335/5

[58] Field of Search ..... 333/101, 105, 333/108; 335/4, 5; 200/504; 330/51, 124 D

[56] References Cited

U.S. PATENT DOCUMENTS

| | | | |
|---|---|---|---|
| 4,070,637 | 1/1978 | Assal | 333/105 |
| 4,618,840 | 10/1986 | Yee | 333/105 |
| 5,065,125 | 11/1991 | Thomson | 335/5 |
| 5,281,936 | 1/1994 | Ciezarek | 335/4 |
| 5,712,603 | 1/1998 | Kim et al. | 333/101 |

OTHER PUBLICATIONS

F. Assal et al, "Network Topologies to Enhance the Reliability of Communications Satellites," *Comsat Technical Review,* vol. 6, No. 2, Fall 1976, pp. 309–322, Sales Flyer, National Research Development Corporation, London, England.

*Primary Examiner*—Paul Gensler

*Attorney, Agent, or Firm*—Georgann S. Grunebach; M. W. Sales

[57] ABSTRACT

Microwave switches are shown which can route signals in an operating frequency band along selectable signal paths between a plurality of microwave ports. The switches are especially suited for forming switching systems that can substitute redundant components for failed components. In one embodiment, waveguide transmission lines and microwave ports are serially coupled in a closed loop with other waveguide transmission lines arranged transversely across the loop. In another embodiment, waveguide modules are formed of three waveguides coupled to a microwave port and the waveguide modules are serially arranged. In each waveguide of these embodiments, conductive reeds are movable between a signal-attenuating position abutting the interior surface of the waveguide and a signal-conducting position substantially coaxial with the waveguide and coupled to the microwave ports at each waveguide end.

24 Claims, 6 Drawing Sheets

MICROWAVE SWITCHES AND REDUNDANT SWITCHING SYSTEMS

BACKGROUND OF THE INVENTION

1. Field of the Invention

The present invention relates generally to microwave switches and more particularly to switches for redundant switching systems.

2. Description of the Related Art

FIG. 1 schematically illustrates a conventional four-port microwave switch 20 which has three switch positions. In this schematic representation, the switch includes ports 22 which are numbered 1 through 4. The ports 22 are coupled with three microwave paths 23 which are carried by a rotor 24. When the rotor 24 is in a first position 24A, ports 1 and 2 are connected and ports 3 and 4 are connected. When the rotor 24 is in a second position 24B, ports 1 and 4 are connected and ports 2 and 3 are connected. When the rotor 24 is in a third position 24C, ports 1 and 3 are connected.

Thus, the microwave switch 20 can selectably couple signals from ports 1 and 3 to each of its other ports. An electronic symbol 30 for this four-port, three position switch is shown in FIG. 2. In the symbol 30, a circle 31 indicates a switch body and the ports 22 are indicated by squares positioned about the body. Diagonal lines 32 indicate the selectable microwave paths of switch positions 24A and 24B of FIG. 1 and a horizontal line 34 indicates the selectable microwave path of switch position 24C.

An embodiment of this switch was disclosed in U.S. Pat. No. 4,618,840 which issued Oct. 21, 1986 in the name of Harold H. Yee, et al. and was assigned to Hughes Electronics, the assignee of the present invention. In this switch embodiment, the ports 22 are coaxial connectors that are positioned at four corners of a housing. The microwave paths 32 are formed on one side of the housing and the microwave path 34 is a diagonal waveguide formed on another side of the housing. The waveguides couple to the signal lines of the coaxial connectors and are dimensioned so that their cutoff frequency is above the operating range of the microwave switch.

Each of the waveguides contains a conductive reed which is moved by a respective reed actuator. The reed is movable between a signal-attenuating position abutting the waveguide's interior surface and a signal-conducting position coaxial with the waveguide and abutting the signal lines at each end of the waveguide. In the signal-attenuating position, signal flow through the waveguide is substantially attenuated because the signals are presented with a waveguide path in cutoff (an exemplary waveguide cross section measuring ~1.8 millimeters×~3.3 millimeters is said to provide a cutoff frequency of ~45 GHz). In the signal-conducting position, signal flow is enhanced because the reed and waveguide form a coaxial line with an air dielectric.

U.S. Pat. Nos. 5,065,125 and 5,281,936 to Thomson et al. and Cierzarek respectively show a four-port switch arrangement in which one of the ports is surrounded by the other three and six waveguide paths interconnect the ports. This arrangement provides the three switch positions of FIG. 1 and, additionally, a fourth position which connects ports 2 and 4. Although this switch arrangement provides an additional switch position, it requires an additional waveguide path and reed.

U.S. Pat. No. 4,070,637 to Assal et al. discloses a four-port switch which provided the four switch positions of Thomson et al. and Cierzarek with a plurality of movable stripline signal lines. Assal et al. show redundant amplifier systems that are based on this four-port, four-position switch (see also a discussion of similar redundant amplifier systems in F. Assal, et al., "Network topologies to enhance the reliability of communications satellites", *Comsat Technical Review,* Vol. 6, No. 2, Fall, 1976, pp. 309–322).

However, the simpler four-port, three-position switch of FIGS. 1 and 2 is sufficient to form redundant switching systems. For example, FIG. 3A and 3B illustrate a switching system 40 in which the switches are indicated by the symbol 30 of FIG. 2. Four of the switches 30 are serially connected to form an input switch set 42. In particular, ports 4 and 2 of adjacent switches are connected with a coaxial cable 44. An output switch set 46 is similarly formed with four switches 30 and three coaxial cables 44.

Primary microwave amplifiers 48A–48D are coupled between corresponding switches of the input and output switch sets 42 and 46. For example, microwave amplifier 48A is coupled between port 3 of switch 30A and port 1 of switch 30B. In addition, redundant microwave amplifiers 49A and 49B are coupled between microwave switches at the top and the bottom of the input and output switch sets 42 and 46. For example, redundant amplifier 49A is coupled between port 2 of switch 30A and port 2 of switch 30B.

In normal operation of the switching system 40, the switches of the input and output switch sets 42 and 46 are all set to the switch position 24B of FIG. 1. As shown in FIG. 3A, this provides four signal paths 50 between a group 52 of input ports 1 and a group 54 of output ports 3. Each of these signal paths 50 includes two corresponding switches 30 of the input and output switch sets 42 and 46 and the primary microwave amplifier that is coupled between those switches. No signals are coupled through the redundant amplifiers 49A and 49B.

The signal paths 50 could be used, for example, in transponder systems of communication satellites. Such systems typically have a plurality of communications channels and must be designed to insure that a predetermined percentage of these channels will be available over the satellite's predicted lifetime. Thus, these systems must be able to substitute redundant components for failed components.

For the switching system 40, this redundancy is illustrated in FIG. 3B in which it is assumed that primary microwave amplifiers 48C and 48D have failed (as indicated by a large x over each of these amplifiers). In response, the system 40 replaces these failed amplifiers with a combination of the remaining primary amplifiers and the redundant amplifiers 49A and 49B. To do so, switch 30C is placed in the switch position 24B of FIG. 1 and all other switches of the input switch set 42 are placed in the switch position 24A. At the same time, switch 30D is placed in the switch position 24A and all other switches of the output switch set 46 are placed in the switch position 24B. Thus, the amplifier paths 50 of FIG. 3A are altered to the paths 60 of FIG. 3B so that primary amplifiers 48A and 48B and redundant amplifiers 49A and 49B continue to provide signal paths between the group 52 of input ports 1 and the group 54 of output ports 3.

Although the switching system 40 uses relatively simple four-port, three position microwave switches and provides redundancy for failure of 50% of its primary amplifiers, it requires eight switches and six coaxial cables. In total, the eight switches have forty waveguides, forty movable reeds and forty actuators (assuming each reed requires a respective actuator). The volume, weight and cost of the switching system 40 becomes even more significant if it is expanded to provide redundancy for a large number of communication channels, especially in systems (e.g., communication satellites) for which these are critical parameters. In addition, reliability is decreased because of the large number of parts.

SUMMARY OF THE INVENTION

The present invention is directed to microwave switches that can route signals in an operating frequency band along selectable paths between a plurality of microwave ports. More particularly, the invention is directed to microwave switches which reduce the number of parts required by conventional switches in forming redundant switching systems. This parts reduction improves reliability and reduces system volume, weight and cost.

These goals are realized with a switch having waveguide modules coupled together in a serial arrangement. Each of the waveguide modules includes an input microwave port and three waveguide transmission lines which are coupled at an input end to the input microwave port. The waveguide modules are coupled together with two waveguide output ends of each waveguide module each coupled to a respective one of two waveguide output ends of an adjacent waveguide module to form an interconnection node;

Output microwave ports are coupled to the output ends at each interconnection node and also coupled at each end of the serial arrangement to a waveguide output end that is not part of an interconnection node.

The waveguide transmission lines are dimensioned to have a cutoff frequency greater than an operating frequency band. Each of the reeds is positioned in a different one of the loop transmission lines and transverse transmission lines and movable between a signal-attenuating position and a signal-conducting position.

A switch embodiment which is suited for forming switch combinations includes microwave ports, loop waveguide transmission lines, transverse waveguide transmission lines and conductive reeds. The loop transmission lines and microwave ports are coupled in series to form a closed loop with each of the loop transmission lines coupled between a different pair of ports. The transverse transmission lines are coupled transversely across the closed loop between a different pair of ports. Each of the reeds is positioned in a different one of the loop and transverse transmission lines and movable between a signal-attenuating position and a signal-conducting position.

In a feature of the invention, the waveguides and reeds can all have substantially the same length and, therefore, the same signal time delay. This feature of the invention can be useful in switching systems which preferably maintain signal phase relationships.

The novel features of the invention are set forth with particularity in the appended claims. The invention will be best understood from the following description when read in conjunction with the accompanying drawings.

DETAILED DESCRIPTION OF THE PREFERRED EMBODIMENTS

Figure 4:
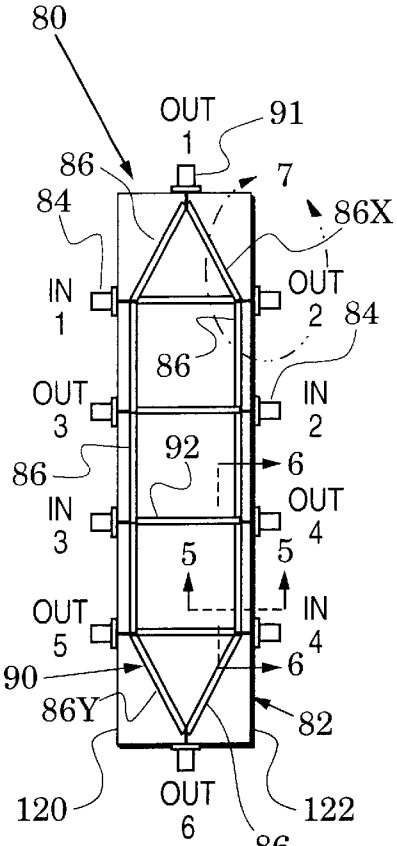
FIG. 4 is a simplified plan view of a microwave switch in accordance with the present invention.

FIG. 4 illustrates a microwave switch 80 in accordance with the present invention. The microwave switch 80 can route signals in an operating frequency band along selectable signal paths between a plurality of microwave ports and is especially suited for forming switching systems that can substitute redundant components for failed components.

The switch 80 has a housing 82 and ten microwave ports in the form of coaxial connectors 84 which are carried by the housing 82. Ten conductive loop reeds 86 and the ten coaxial connectors 84 are coupled in series to form a closed loop 90 with each of the loop reeds 86 coupled between a different pair of the coaxial connectors 84.

An arbitrary one of the coaxial connectors 84 is designated as a loop end connector 91. Four transverse reeds 92 are coupled transversely across the closed loop 90 between a different pair of the coaxial connectors 84 with the ends of each transverse reed 92 being spaced from the loop end connector 91 by the same number of loop reeds 86.

In FIG. 4, each of the loop reeds 86 and transverse reeds 92 define the signal path of a reed and a corresponding waveguide transmission line between pairs of coaxial connectors 84. For clarity of illustration, only the reed and coaxial connector structural relationship is shown in FIG. 4 and the reed, waveguide transmission line and connector structural relationship is detailed in FIGS. 5A, 5B, 6, 7A, 7B and 8.

Figure 5C:
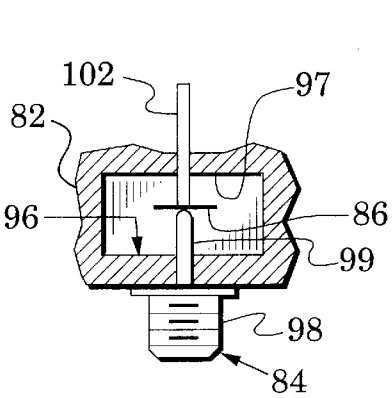
FIG. 5C is a view similar to FIG. 5A with the coaxial signal line in a different orientation.
Figure 5B:
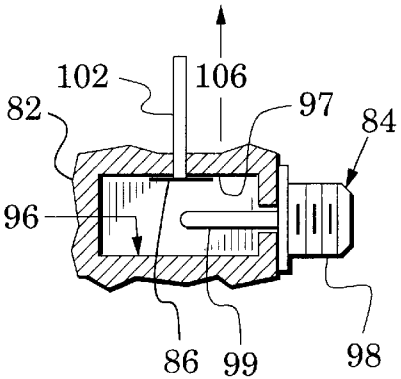
FIG. 5B is a view similar to FIG. 5A with the movable reed in a signal-attenuating position.
Figure 5A:
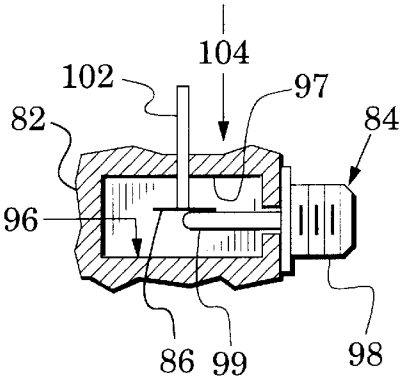
FIG. 5A is an enlarged view along the plane 5—5 of FIG. 4 showing a cross section of an exemplary waveguide transmission line and a movable reed with the reed in a signal-conducting position with a coaxial signal line.

For example, FIG. 5A shows a loop reed 86 positioned in a loop transmission line in the form of a waveguide 96 that has an internal surface 97. The coaxial connector 84 is a conventional one having an outer conductive shield member 98 coaxially arranged with an inner signal line 99. The coaxial connector 84 is carried by the housing 82 with the signal line 99 isolated from the housing 82 and extending into the waveguide 96. The loop reed 86 is formed of a low-loss microwave material, e.g., beryllium copper, and is coupled to a post 102 which is formed of an insulative dielectric.

Figure 6:
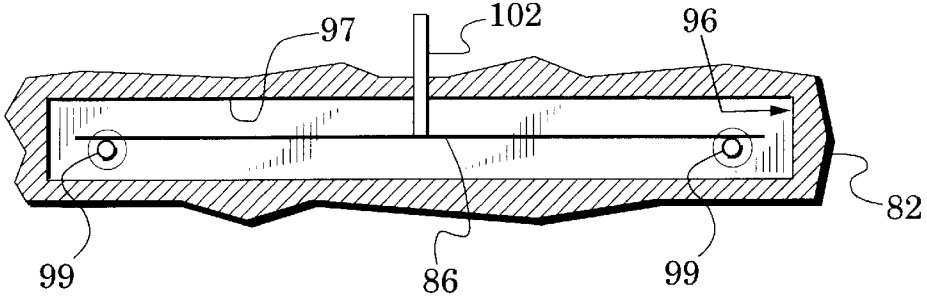
FIG. 6 is an enlarged and rotated view along the plane 6—6 of FIG. 4 showing cross section of an exemplary waveguide transmission line and a movable reed with the reed in a signal-conducting position between a pair of coaxial signal lines.

The post 102 is slidably received through the housing 82. As shown in FIG. 5A, it can therefore move (indicated by the movement arrow 104) the loop reed 86 to a signal-conducting position where it is substantially coaxial with the waveguide 96 and abuts the signal line 99. Alternatively, FIG. 5B shows that the post 94 can move (indicated by the movement arrow 106) the loop reed 86 to a signal-attenuating position where it abuts the waveguide's internal surface 97. FIG. 6 shows the loop reed 86 in its signal-conducting position between a pair of coaxial connector signal lines 99.

In FIGS. 5A and 6, the reed 86 and the waveguide 96 form an air-dielectric coaxial line which is suitable for conducting microwave signals between the coaxial connector signal lines 99. The waveguide 96 has transverse dimensions such that its cutoff frequency is greater than the operating frequency band of the microwave switch (80 in FIG. 4). Accordingly, the waveguide 96 substantially blocks signals between coaxial connector signal lines 99 when the loop reed 86 is in the signal-attenuating position of FIG. 5B.

Each of the transverse reeds 92 of FIG. 4 has a corresponding transverse waveguide and their structural relationship is similar to that shown in FIGS. 5A, 5B and 6 for the loop reeds 86 and their corresponding waveguides. Although the waveguide 96 is shown with a rectangular cross section in FIGS. 5A and 5B, any suitable waveguide cross section may be used if it is dimensioned to give the waveguide a cutoff frequency that is greater than the switch's operating frequency band. In addition, the coaxial connector 84 can have any orientation that brings its signal line 99 into contact with the reed 86. For example, FIG. 5C shows an orientation in which the signal line 99 is aligned with the post 102.

Figure 7A:
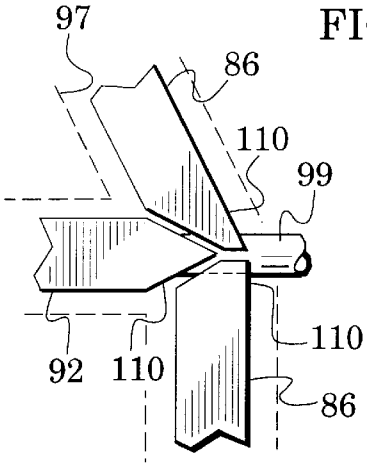
FIG. 7A is an enlarged view of the reeds and coaxial signal line within the curved line 7 of FIG. 4.

FIG. 7A illustrates an exemplary coupling of loop reeds 86, a transverse reed 92 and a coaxial connector signal line 99. In this figure, the ends 110 of the reeds are tapered that they are spaced from each and can move independently to abut the signal line 99. The internal surfaces 97 of the waveguide transmission lines 96 which correspond to the loop reeds 86 and the transverse reed 92 are indicated by broken lines (for clarity of illustration, the spacing from the reeds to the interior surfaces has been shortened).

Figure 8:
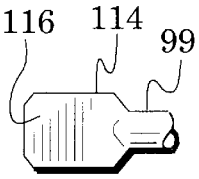
FIG. 8 is a view of another embodiment of the coaxial signal line of FIGS. 7A and 7B.
Figure 7B:
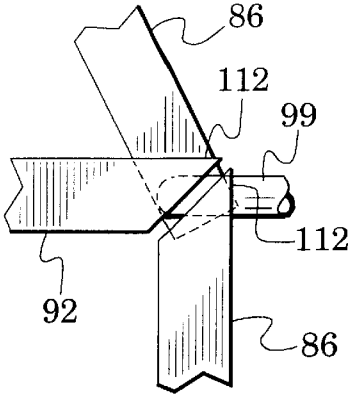
FIG. 7B shows another embodiment of the reeds and coaxial signal line within the curved line 7 of FIG. 4.

FIG. 7B illustrates another exemplary coupling in which the ends 112 of the transverse reed 92 and one of the loop reeds 86 are tapered so that they are spaced from each other and can move-independently to abut the signal line 99. The other loop reed 86 is positioned below the signal line 99 so that it can abut its opposite side. This loop reed would move between the signal line 99 and the lower interior surface 97 in FIG. 5B. FIG. 8 shows an alternative shape 114 for the end of the signal line 99 of FIGS. 7A and 7B. This shape 114 provides a greater surface 116 to facilitate contact between it and the ends of the loop reeds 86 and transverse reed 92.

In operation of the microwave switch 80 of FIG. 4, each of the coaxial connectors 84 along either a housing side 120 or a housing side 122 can be coupled via loop reeds 86 or transverse reeds 92 to three others of the coaxial connectors 84. An exemplary labeling of the coaxial connectors 84 is shown in FIG. 4 to illustrate this concept. For example, the coaxial connector labeled IN 1 can be coupled to any of the coaxial connectors labeled OUT 1, OUT 2 and OUT 3. Similarly, the coaxial connector labeled IN 2 can be coupled to any of the coaxial connectors labeled OUT 2, OUT 3 and OUT 4.

In another feature of the invention, each of the loop reeds 86 and transverse reeds 92 and their corresponding waveguides 96 have the same length so that the transit time of microwave signals between adjacent ones of the coaxial connectors 84 of FIG. 4 are the same. This feature can be useful in maintaining phase relationships of signals that are routed through the microwave switch 80.

Figure 9:
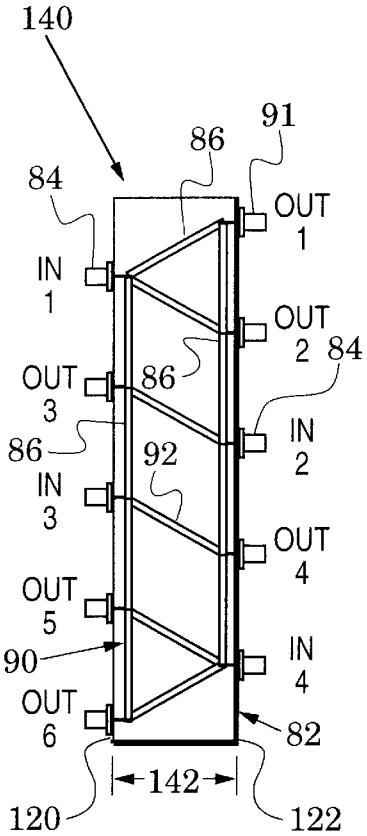

FIG. 9 shows another microwave switch embodiment 140. The switch 140 is similar to the switch 80 of FIG. 4 with like elements indicated by like reference numbers. In the switch 140, the transverse reeds 92 are set in a diagonal relationship (and their corresponding waveguide transmission lines) with the housing 82 and coaxial connectors labeled OUT 1 and OUT 6 are positioned respectively on housing sides 122 and 120. This embodiment maintains the equal length feature of reeds and waveguide transmission lines (of the switch 80) but reduces the width 142 between the housing sides 120 and 122 to facilitate use of the switch in restricted-space applications.

Figure 10:
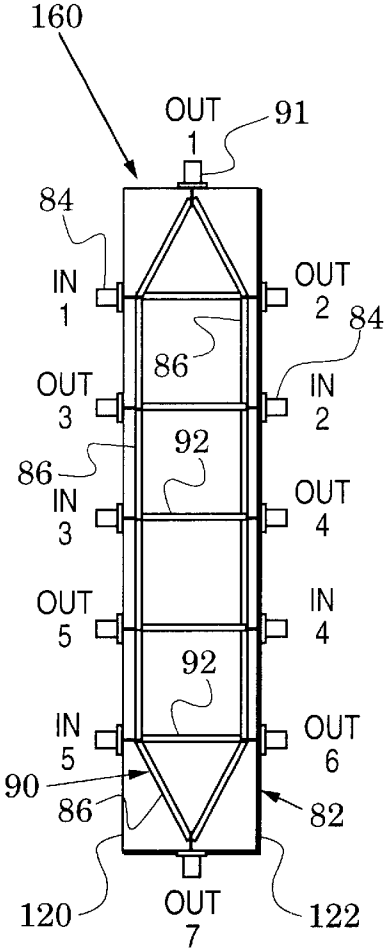

FIG. 10 shows another microwave switch embodiment 160. The switch 160 is similar to the switch 80 of FIG. 4 with like elements indicated by like reference numbers. In contrast to the switch 80, the switch 160 has twelve microwave ports in the form of coaxial connectors 84. Accordingly, the switch 160 has an additional input coaxial connector 84 which is labeled IN 5 and an additional output coaxial connector labeled OUT 7.

The microwave switch 160 illustrates that the teachings of the invention can be generalized to form switches for routing signals between n switch ports in which n is an even integer greater than 4. Relationships between the numbers of microwave ports 84, loop reeds 86, transverse reeds 92 and waveguide transmission lines is shown in Table 1 for exemplary switches in which n equals 6, 8, 10 and 12.

TABLE 1

| PORTS | LOOP TRANSMISSION LINES | TRANSVERSE TRANSMISSION LINES | REEDS |
|---|---|---|---|
| 6 | 6 | 2 | 8 |
| 8 | 8 | 3 | 11 |
| 10 | 10 | 4 | 14 |
| 12 | 12 | 5 | 17 |

Figure 11:
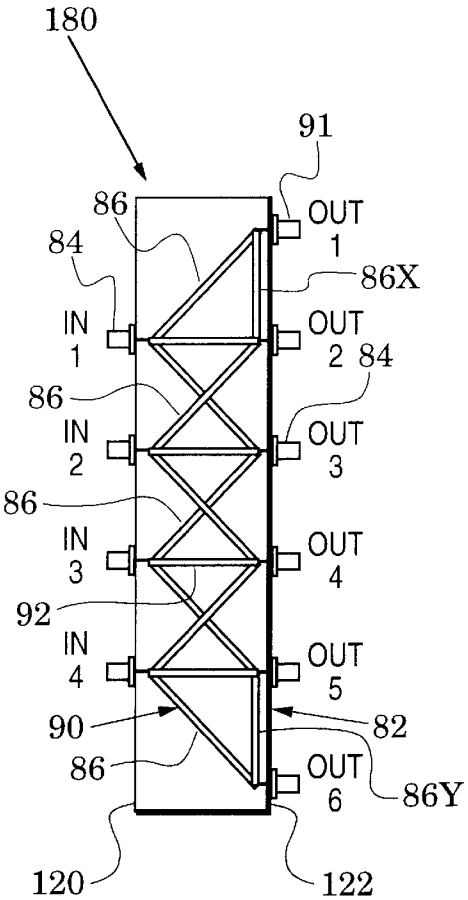
FIGS. 9–11 are simplified plan views of other microwave switches in accordance with the present invention.

FIG. 11 shows another microwave switch embodiment 180. The switch 180 is similar to the switch 80 of FIG. 4 with like elements indicated by like reference numbers. In the switch 180, selected coaxial connectors 84 have been moved between the housing sides 120 and 122 to position coaxial connectors labeled IN 1, IN 2, IN 3 and IN 4 on the housing side 120 and coaxial connectors labeled OUT 1, OUT 2, OUT 3 OUT 4, OUT 5 and OUT 6 on the housing side 122.

Accordingly, some of the loop reeds 86 (and their corresponding waveguide transmission lines) cross over each other. In an exemplary fabrication of this embodiment, the various reeds (and their corresponding waveguides) are positioned in two different planes. The signal lines (99 in FIG. 8) of the coaxial connectors are modified to extend into each of the two planes to facilitate contact with the movable reeds.

Although the loop reeds 86 and transverse reeds 92 and their corresponding waveguides 96 no longer have a common length in this switch embodiment, the arrangement of the microwave switch 180 may facilitate interconnections in some applications of the switches of the invention.

Figure 12:
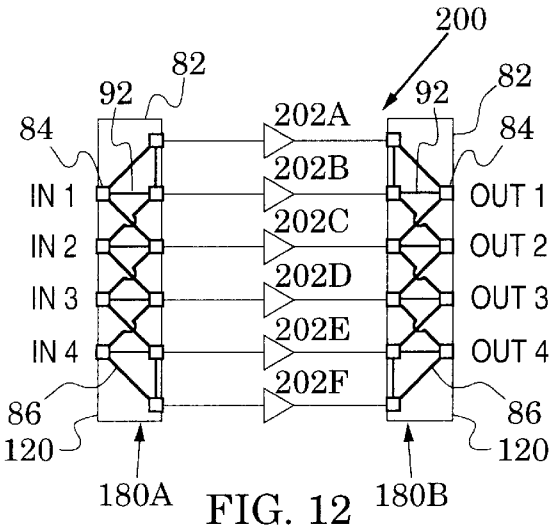
FIG. 12 is a block diagram of a redundant amplifier system which includes the microwave switch of FIG. 11.

For example, a redundant amplifier system 200 is illustrated in FIG. 12. A plurality of microwave amplifiers 202A–202F are positioned between two of the microwave switches 180 which are referenced as an input switch 180A and an output switch 180B. For clarity of illustration, the switches 180A and 180B are shown in a simplified form with squares indicating the coaxial connectors 84 and solid lines indicating the movable loop reeds 86 and transverse reeds 92.

The microwave ports on the housing wall 120 of the input switch 180A are labeled as they are in FIG. 11. For this application, the output switch 180B is turned with its housing wall 120 to the right and, to avoid confusion, the microwave ports on this wall are labeled OUT 1, OUT 2, OUT 3 and OUT 4.

Figure 13C:
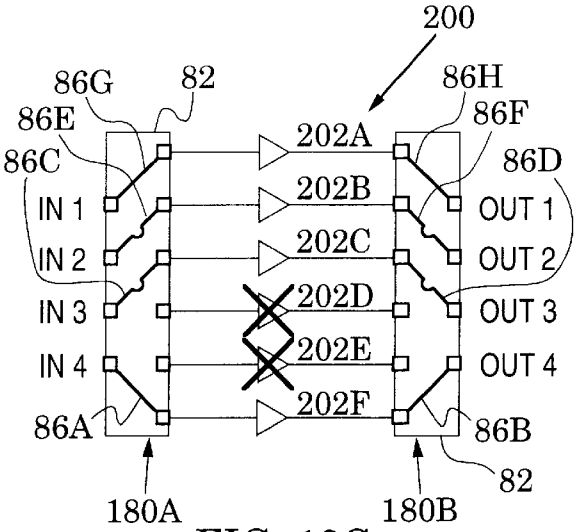
FIGS. 13A–13C illustrate operational modes of the redundant amplifier system of FIG. 12.
Figure 13B:
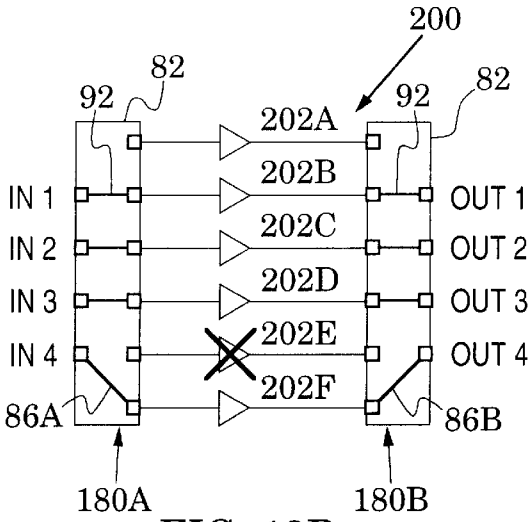
Figure 13A:
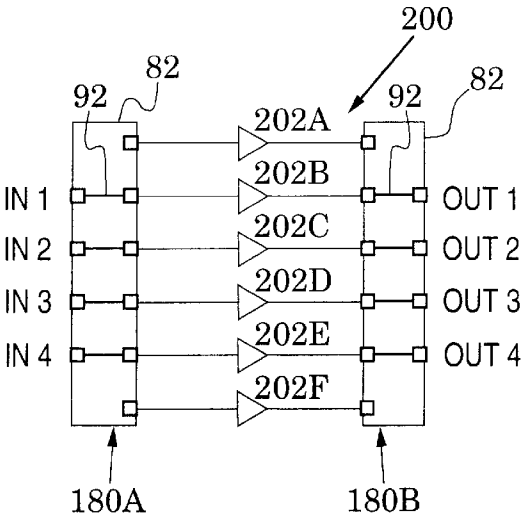

Operational modes of the redundant amplifier system 200 are shown in FIGS. 13A–13C. In these figures, only those reeds in their signal-conducting positions (see FIG. 5A) are shown. In FIG. 13A, the transverse reeds 92 of the switches 180A and 180B are moved to their signal-conducting positions and signals are routed to the outputs of switch 180B through amplifiers 202B, 202C, 202D and 202E. FIG. 13B indicates with a large X that amplifier 202E has failed. Accordingly, loop reeds 86A and 86B are moved to their signal-conducting positions and signals are routed through amplifiers 202B, 202C, 202D and 202F. FIG. 13C indicates with large X's that amplifiers 202D and 202E have failed. Accordingly, loop reeds 86A, 86B, 86C, 86D, 86E, 86F, 86G and 86H are moved to their signal-conducting positions and signals are routed through amplifiers 202A, 202B, 202C and 202F.

Figure 2:
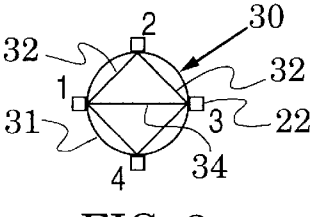
FIG. 2 (PRIOR ART)
FIG. 2 illustrates a typical symbol for the switch of FIG. 1.
Figure 1:
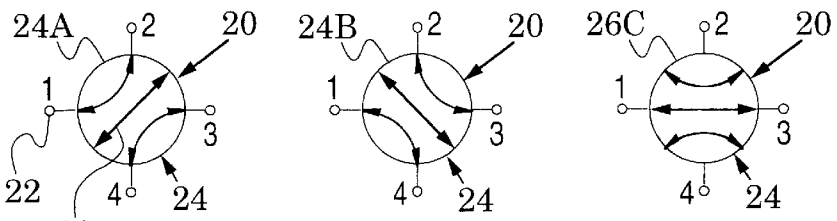
FIG. 1 (PRIOR ART)
FIG. 1 is a schematic diagram of a conventional four-port, three position microwave switch.
Figure 3B:
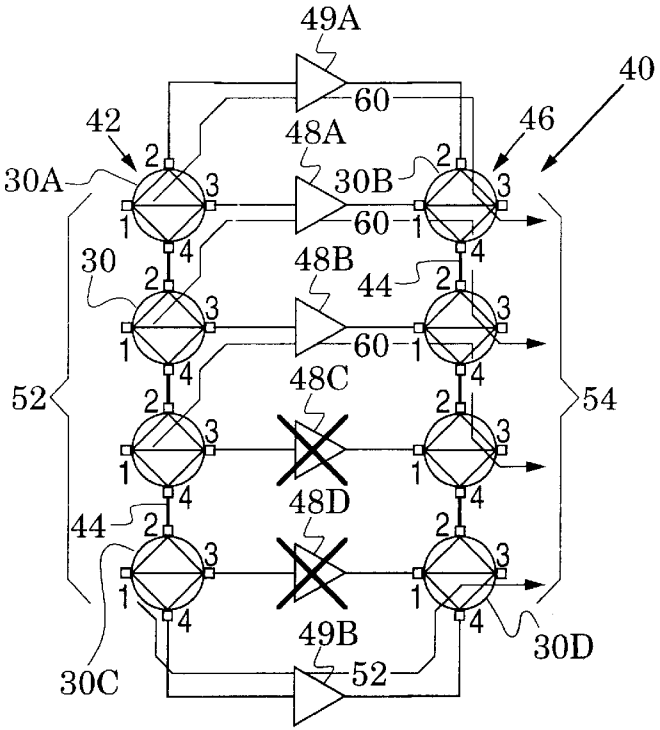
FIG. 3B (PRIOR ART)
FIG. 3B is a block diagram which shows redundant signal routing paths about failed amplifiers in the amplifier system of FIG. 3A.
Figure 3A:
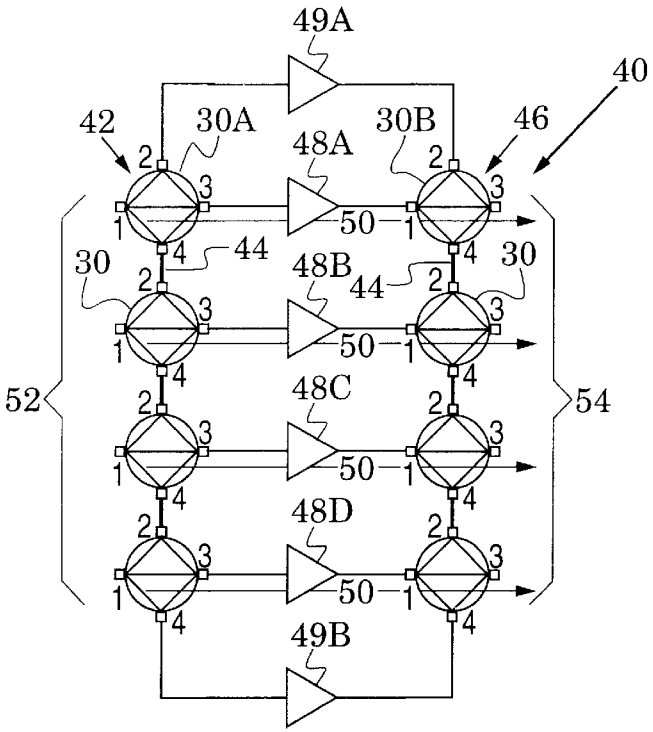
FIG. 3A (PRIOR ART)
FIG. 3A is a block diagram which shows exemplary signal routing paths through a conventional redundant microwave amplifier system based on the switch of FIG. 1.

The redundant amplifier system 200 provides routing through two redundant amplifiers and four primary amplifiers. Thus, its redundancy is similar to that of the conventional amplifier system 40 of FIGS. 3A and 3B. The system 200 requires two switches with a total of twenty eight waveguides, twenty eight reeds and twenty eight actuators (assuming each reed requires a respective actuator). In contrast, the system 40 required eight switches and six coaxial cables and the switches included forty waveguides, forty movable reeds and forty actuators (assuming each reed requires a respective actuator). From this example, it is seen that microwave switches of the invention provide significant reductions of volume, weight and cost and increase reliability because of reduced parts count.

The loop reeds 86X and 86Y which are designated in FIG. 11 (and their corresponding waveguide transmission lines) were not used in the operational modes of FIGS. 13A–13C. These loop reeds respectively connect the coaxial connector pair labeled OUT 1 and OUT 2 and the coaxial connector pair labeled OUT 5 and OUT 6. However, these loop reeds are particularly useful for coupling two or more microwave switches together.

For example, two of the microwave switches 80 of FIG. 4 (in which the reeds 86X and 86Y are also designated) can be coupled together by coupling the port labeled OUT 6 of a first switch to the port labeled OUT 1 of a second switch. In this combined switch, the loop reed 86X provides a routing path between the port labeled IN 4 of the first switch and the port labeled OUT 2 of the second switch. Similarly, the loop reed 86Y provides a routing path between the port labeled IN 1 of the second switch and the port labeled OUT 5 of the first switch.

Figure 15:
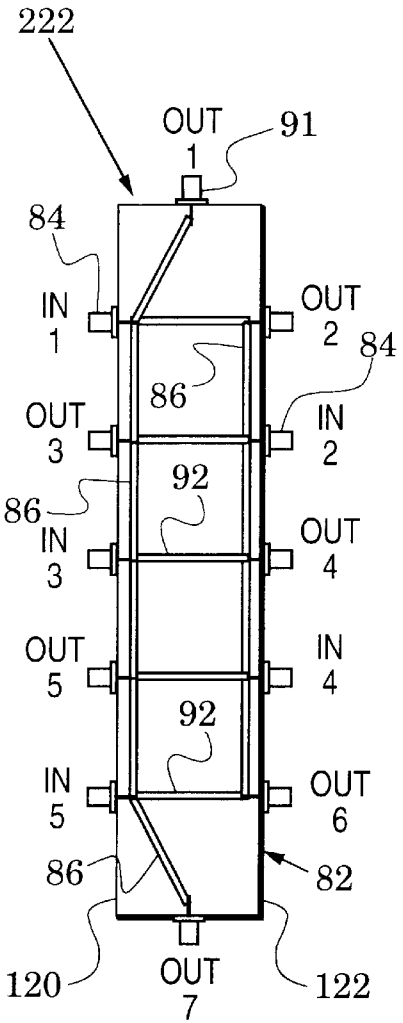
FIG. 15 is a simplified plan view of the microwave switch of FIG. 10 with two loop reeds eliminated.

The routing capabilities of such combined switches can also be realized by using expanded versions of the switch 80, e.g., as exemplified by the expanded switch 160 of FIG. 10. When switch combination capability is not required, the loop reeds 86X and 86Y may be eliminated. Elimination of these reeds in the microwave switch 80 of FIG. 4 and the microwave switch 160 of FIG. 10 produces the microwave switch 220 of FIG. 14 and the microwave switch 222 of FIG. 15 respectively (in corresponding figures, like elements are indicated by like reference numbers).

Figure 16:
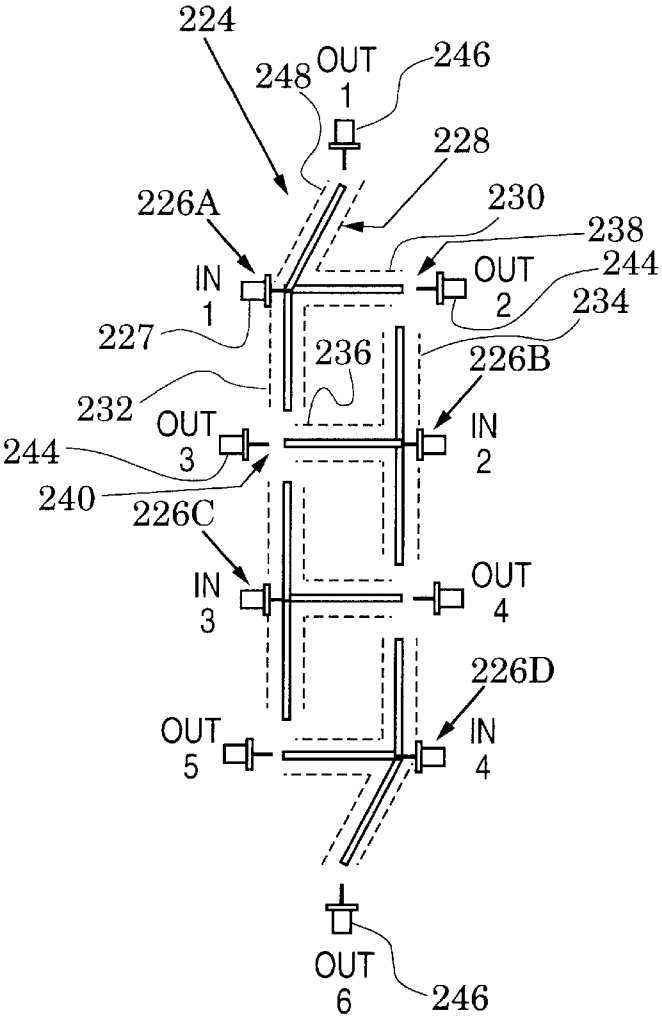
FIG. 16 is an exploded view of the microwave switch of FIG. 14.
Figure 14:
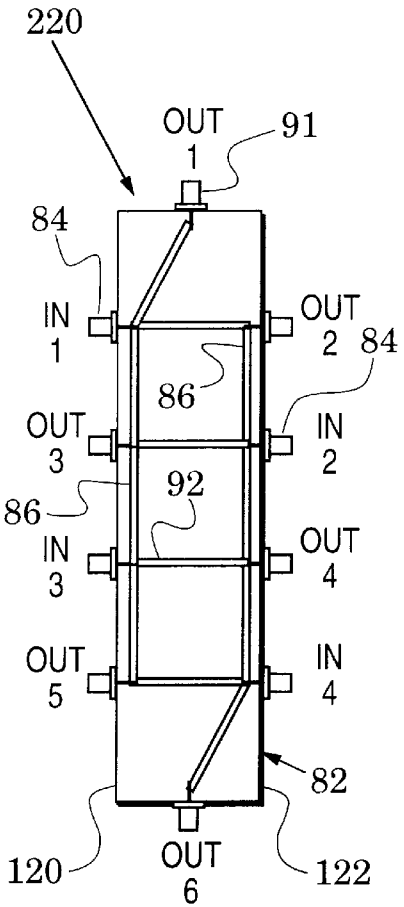
FIG. 14 is a simplified plan view of the microwave switch of FIG. 4 with two loop reeds eliminated.

The general structure of the switches 220 and 222 may be examined in FIG. 16 which is an exploded version 224 of FIG. 14 (with the housing 82 eliminated for clarity of illustration). It was previously stated that each reed defines the signal path of a reed and a corresponding waveguide transmission line between pairs of coaxial connectors. These waveguides are indicated by broken lines in FIG. 16.

Accordingly, FIG. 16 shows that the switch 224 has four waveguide modules 226A, 226B, 226C and 226D which each include a microwave port 227 and three waveguide transmission lines 228. Each of the waveguides has an input end and in each waveguide module the input ends are coupled to the microwave port 227 of that waveguide module. To form the microwave switch 220, the waveguide modules 226A, 226B, 226C and 226D are coupled together in a serial arrangement, i.e., arranged in sequential order between the microwave ports labeled OUT 1 and OUT 6.

Each of the waveguides 228 also has an output end and two output ends of each waveguide module are each coupled to a respective one of two output ends of an adjacent module to form an interconnection node. For example, the output ends 230 and 232 of waveguide module 226A are coupled to output ends 234 and 236 of waveguide module 226B and these couplings form interconnection nodes 238 and 240.

Additional microwave ports 244 are coupled to each of these interconnection nodes and a final pair of microwave ports 246 are coupled to a waveguide output end at each end of the serial arrangement of waveguide modules. For example, microwave port 246 is coupled to the output end 248 of waveguide module 226A. As in other microwave switches of the invention, e.g., the switch 80 of FIG. 4, the microwave switch 224 is completed by positioning a conductive reed in each waveguide 228 so that the reed is movable between a signal-attenuating position and a signal-conducting position.

Figure 17:
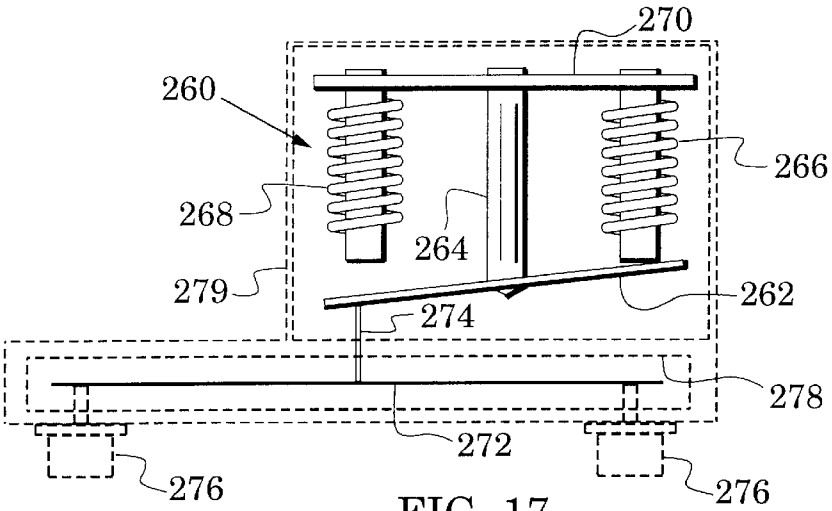
FIG. 17 (PRIOR ART)

The reeds of the invention may be moved with various conventional actuators. For example, FIG. 17 illustrates a conventional actuator 260 (similar to an actuator of U.S. Pat. No. 4,618,840). The actuator 260 includes a clapper 262 (a pivotable armature) which pivots about the end of a permanent magnet 264 in response to pulses applied to a pair of electromagnets 266 and 268. A pole piece 270 completes magnetic circuits through the permanent magnet, the clapper and the electromagnets so that the clapper 262 remains in one of two positions (one position is shown in FIG. 17) between drive pulses.

One end of the clapper 262 moves a reed 272 via a dielectric post 274. The reed 272 is shown in its signal-conducting position abutting signal lines of coaxial connectors 276 in a waveguide 278. A housing 279 forms the waveguide and also shields the actuator 260.

Figure 18:
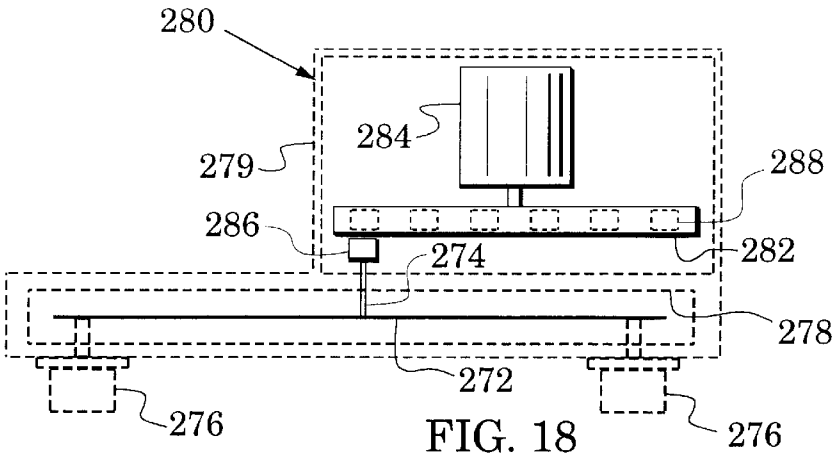
FIG. 18 (PRIOR ART)

FIG. 18 illustrates another conventional actuator 280 (similar to an actuator of U.S. Pat. No. 5,065,125). The actuator 280 includes a rotatable armature 282 which is driven by a stepper motor 284. The post 274 of a reed 272 carries a permanent magnet 286. The rotatable armature carries a plurality of permanent magnets 288 which have predetermined polarities. The reed 272 can be selectively positioned in the waveguide 278 by rotating the armature 282 to place a permanent magnet over the post 274 that either attracts or repels the magnet 286 of the post. The rotatable armature 282 could be converted to have a linear motion with the addition of a rack and pinion structure.

Figure 19:
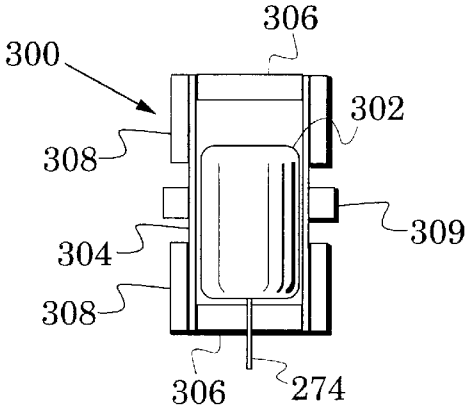
FIG. 19 (PRIOR ART)
FIGS. 17–19 are views of exemplary actuators for moving the reed of FIG. 6.

FIG. 19 illustrates still another conventional actuator 300 which can replace the actuator 260 of FIG. 17. This actuator (similar to an actuator manufactured by National Research Development Corporation of London, England) has a cylindrical armature 302 that moves linearly in a housing 304 and can be latched in an upper and a lower position to appropriately position the reed post 274. Samarium-cobalt magnets 306 are located inside the upper and lower ends of the housing 304 with like poles facing each other. Solenoids 308 are located about the upper and lower ends of the housing and pole pieces 309 are spaced about the middle of the housing.

In operation, the armature 302 is attracted to the nearest of the magnets 306 and is thus held in one of two selectable positions. When a solenoid is pulsed, the resulting magnetic field overcomes the field of an associated one of the permanent magnets 306 and causes the armature 302 to move towards the other permanent magnet 306.

Microwave switches of the invention provide a plurality of selectable signal routing paths. In various switch embodiments (e.g., the switch 80 of FIG. 4), signal ports have been labeled as input ports and output ports. However, this labeling is for convenience of description and is not intended to limit the direction of signal flow. The actual signal flow direction is generally determined by the characteristics of systems (e.g., the redundant amplifier system 200 of FIG. 12) in which the switches are embedded.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A microwave switch for routing signals in an operating frequency band along selectable signal paths between n switch ports wherein n is an even integer greater than 4, comprising:

0.5n−1 waveguide modules which each include:

a) an input microwave port having a signal line; and b) three waveguide transmission lines, each having an input end and an output end with said input end coupled to said input microwave port, each of said waveguide transmission lines also having an interior surface and dimensioned to have a cutoff frequency greater than said operating frequency band;

wherein said waveguide modules are coupled together in a serial arrangement with two output ends of each waveguide module each coupled to a respective one of two output ends of an adjacent waveguide module to form an interconnection node;

0.5n+1 output microwave ports, each having a signal line with a different one of said output microwave ports coupled to the output ends at each interconnection node and a different one of said output microwave ports coupled at each end of said serial arrangement to an output end that is not part of an interconnection node; and 1.5n−3 conductive reeds, each of said reeds positioned in a different one of said waveguide transmission lines and movable between a signal-attenuating position abutting the interior surface of that waveguide transmission line and a signal-conducting position substantially coaxial with that waveguide transmission line and abutting signal lines of the microwave ports coupled to that waveguide transmission line.

2. The microwave switch of claim 1, wherein all of said microwave transmission lines have substantially the same length and all of said reeds have substantially the same length.

3. The microwave switch of claim 1, wherein each of said microwave ports comprises a coaxial connector which has an outer shield member coaxially arranged with said signal line.

4. The microwave switch of claim 1, wherein said waveguide transmission lines each have a rectangular cross section.

5. The microwave switch of claim 1, wherein each of said reeds comprises beryllium copper.

6. The microwave switch of claim 1, further including at least one actuator coupled to said reeds for moving them between said signal-attenuating position and said signal-conducting position.

7. The microwave switch of claim 6, wherein said actuator includes:

a clapper coupled to said reed; and a pair of electromagnets positioned to pivot said clapper between predetermined positions.

8. The microwave switch of claim 6, wherein said actuator includes;

a reed magnet carried by said reed;

an armature having a plurality of armature magnets of different polarities; and a stepper motor coupled to said armature to position selected ones of said armature magnets adjacent said reed magnet.

9. The microwave switch of claim 6, wherein said actuator includes;

an armature coupled to said reed;

first and second spaced magnets for holding said armature in first and second positions; and first and second electromagnets for attracting said armature to said first and second positions.

10. A redundant amplifier system, comprising:

an input microwave switch;

an output microwave switch;

wherein n is an even integer greater than 4 and said input and output microwave switches each include:

a) 0.5n−1 waveguide modules which each have:

1) an input microwave port having a signal line; and 2) three waveguide transmission lines, each having an input end and an output end with said input end coupled to said input microwave port, each of said waveguide transmission lines also having an interior surface and dimensioned to have a cutoff frequency greater than said operating frequency band;

wherein said waveguide modules are coupled together in a serial arrangement with two output ends of each waveguide module each coupled to a respective one of two output ends of an adjacent waveguide module to form an interconnection node;

b) 0.5n+1 output microwave ports, each having a signal line with a different one of said output microwave ports coupled to the output ends at each interconnection node and a different one of said output microwave ports coupled at each end of said serial arrangement to an output end that is not part of an interconnection node; and c) 1.5n−3 conductive reeds, each of said reeds positioned in a different one of said waveguide transmission lines and movable between a signal-attenuating position abutting the interior surface of that waveguide transmission line and a signal-conducting position substantially coaxial with that waveguide transmission line and abutting signal lines of the microwave ports coupled to that waveguide transmission line; and a plurality of amplifiers, each coupled between a different one of said output microwave ports of said input microwave switch and a different one of said output microwave ports of said output microwave switch.

11. The redundant amplifier system of claim 10, wherein all of said microwave transmission lines have substantially the same length and all of said reeds have substantially the same length.

12. The redundant amplifier system of claim 10, further including at least one actuator coupled to said reeds for moving them between said signal-attenuating position and said signal-conducting position.

13. A microwave switch for routing signals in an operating frequency band along selectable signal paths between a plurality of switch ports, comprising:

n microwave ports wherein n is an even integer greater than 4, each of said ports having a signal line;

n loop waveguide transmission lines, each having an interior surface and dimensioned to have a cutoff frequency greater than said operating frequency band, wherein said ports and said loop waveguide transmission lines are coupled in series to form a closed loop with each of said loop waveguide transmission lines coupled between a different pair of said ports and one of said ports designated as a loop end port;

0.5n−1 transverse waveguide transmission lines, each having an interior surface and a pair of ends and dimensioned to have a cutoff frequency greater than said operating frequency band, each of said transverse waveguide transmission lines coupled transversely across said closed loop between a different pair of said ports with each of its pair of ends spaced from said loop end port by the same number of loop waveguide transmission lines; and 1.5n−1 conductive reeds, each of said reeds positioned in a different one of said loop waveguide transmission lines and said transverse waveguide transmission lines and movable between a signal-attenuating position abutting the interior surface of that waveguide transmission line and a signal-conducting position substantially coaxial with that waveguide transmission line and abutting the signal lines of the ports coupled to that waveguide transmission line.

14. The microwave switch of claim 13, wherein all of said loop transmission lines and said transverse transmission lines have substantially the same length and all of said reeds have substantially the same length.

15. The microwave switch of claim 13, wherein each of said microwave ports comprises a coaxial connector which has an outer shield member coaxially arranged with said signal line.

16. The microwave switch of claim 13, wherein said loop waveguide transmission lines and said transverse waveguide transmission lines each have a rectangular cross section.

17. The microwave switch of claim 13, wherein each of said reeds comprises beryllium copper.

18. The microwave switch of claim 13, further including at least one actuator coupled to said reeds for moving them between said signal-attenuating position and said signal-conducting position.

19. The microwave switch of claim 18, wherein said actuator includes:

a clapper coupled to said reed; and a pair of electromagnets positioned to pivot said clapper between predetermined positions.

20. The microwave switch of claim 18, wherein said actuator includes;

a reed magnet carried by said reed;

an armature having a plurality of armature magnets of different polarities; and a stepper motor coupled to said armature to position selected ones of said armature magnets adjacent said reed magnet.

21. The microwave switch of claim 18, wherein said actuator includes;

an armature coupled to said reed;

first and second spaced magnets for holding said armature in first and second positions; and first and second electromagnets for attracting said armature to said first and second positions.

22. A redundant amplifier system, comprising:

an input microwave switch;

an output microwave switch;

wherein said input switch and said output switch each include:

a) n microwave ports wherein n is an even integer greater than 4, each of said ports having a signal line;

b) n loop waveguide transmission lines, each having an interior surface and dimensioned to have a cutoff frequency greater than said operating frequency band, wherein said ports and said loop waveguide transmission lines are coupled in series to form a closed loop with each of said loop waveguide transmission lines coupled between a different pair of said ports and one of said ports designated as a loop end port;

c) 0.5n−1 transverse waveguide transmission lines, each having an interior surface and a pair of ends and dimensioned to have a cutoff frequency greater than said operating frequency band, each of said transverse waveguide transmission lines coupled transversely across said closed loop between a different pair of said ports with each of its pair of ends spaced from said loop end port by the same number of loop waveguide transmission lines; and d) 1.5n−1 conductive reeds, each of said reeds positioned in a different one of said loop waveguide transmission lines and said transverse waveguide transmission lines and movable between a signal-attenuating position abutting the interior surface of that waveguide transmission line and a signal-conducting position substantially coaxial with that waveguide transmission line and abutting the signal lines of the ports coupled to that waveguide transmission line; and a plurality of amplifiers, each coupled between a different one of said ports of said input switch and a different one of said ports of said output switch.

23. The redundant amplifier system of claim 22, wherein all of said loop transmission lines and said transverse transmission lines have substantially the same length and all of said reeds have substantially the same length.

24. The redundant amplifier system of claim 22, further including at least one actuator coupled to said reeds for moving them between said signal-attenuating position and said signal-conducting position.

* * * * *